US007591094B2

(12) United States Patent
Whitehead

(10) Patent No.: US 7,591,094 B2
(45) Date of Patent: Sep. 22, 2009

(54) PERFORATED MULTI-LAYER OPTICAL FILM LUMINAIRE

(75) Inventor: Lorne A. Whitehead, Vancouver (CA)

(73) Assignee: The University of British Columbia, Vancouver, British Columbia (CA)

( * ) Notice: Subject to any disclaimer, the term of this patent is extended or adjusted under 35 U.S.C. 154(b) by 186 days.

(21) Appl. No.: 11/139,550

(22) Filed: May 31, 2005

(65) Prior Publication Data

US 2006/0268554 A1 Nov. 30, 2006

(51) Int. Cl.
*G09F 13/04* (2006.01)

(52) U.S. Cl. ..... 40/564; 40/579; 40/541

(58) Field of Classification Search ..... 362/330
See application file for complete search history.

(56) References Cited

U.S. PATENT DOCUMENTS

| | | | | |
|---|---|---|---|---|
| 4,729,068 | A | 3/1988 | Ohe | |
| 5,243,506 | A | 9/1993 | Whitehead | |
| 5,721,603 | A | 2/1998 | De Vaan et al. | |
| 5,746,503 | A | 5/1998 | Hillstrom et al. | |
| 5,882,774 | A * | 3/1999 | Jonza et al. | 428/212 |
| 6,024,462 | A | 2/2000 | Whitehead | |
| 6,079,844 | A | 6/2000 | Whitehead et al. | |
| 6,080,467 | A | 6/2000 | Weber et al. | |
| 6,208,466 | B1 | 3/2001 | Liu et al. | |
| 6,905,220 | B2 * | 6/2005 | Wortman et al. | 362/627 |
| 2002/0141194 | A1 | 10/2002 | Wortman et al. | |

OTHER PUBLICATIONS

"Vikuiti™ Enhanced Specular Reflector (ESR)", 2002 product brochure of 3M Electronic Display Lighting, Optical Systems Division, St.Paul, MN.

"Vikuiti™ Enhanced Specular Reflector (ESR) Application Guidelines", 2003 brochure of 3M Electronic Display Lighting, Optical Systems Division, St.Paul, MN.

International Search Report mailed Apr. 24, 2006 by the Canadian Intellectual Property Office (CIPO) in respect of Applicant's corresponding PCT application.

Written Opinion of the International Searching Authority mailed Apr. 24, 2006 in respect of Applicant's corresponding PCT application.

* cited by examiner

*Primary Examiner*—Lesley D Morris
*Assistant Examiner*—Christopher E Veraa
(74) *Attorney, Agent, or Firm*—Oyen Wiggs Green & Mutala LLP

(57) ABSTRACT

The light emitting surface of an image display light box is formed of multi-layer optical film having a reflectance greater than 95% and preferably about 99% or greater. This more efficiently utilizes light rays emitted by the light box's internal light source, since the multi-layer optical film reflects the light rays many times before the rays are absorbed and lost. Consequently, the light emitting surface can have a light transmissivity characteristic which is macroscopically invariant as a function of position on the light emitting surface. Light boxes utilizing prior art reflective materials require cumbersome, time-consuming, iterative trial and error techniques which must be customized for each light box in order to compensate for light absorption losses by imparting a variable transmissivity characteristic to the reflective material.

29 Claims, 3 Drawing Sheets

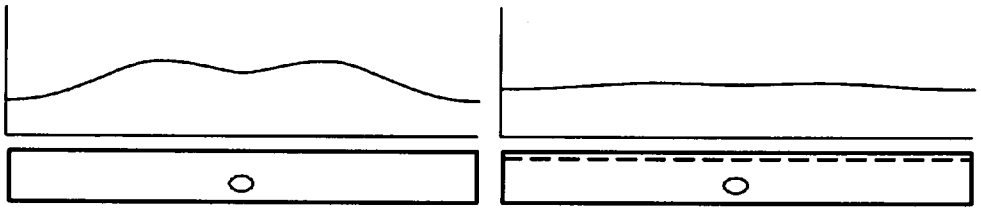
FIGURE 5B
FIGURE 5A
(PRIOR ART)
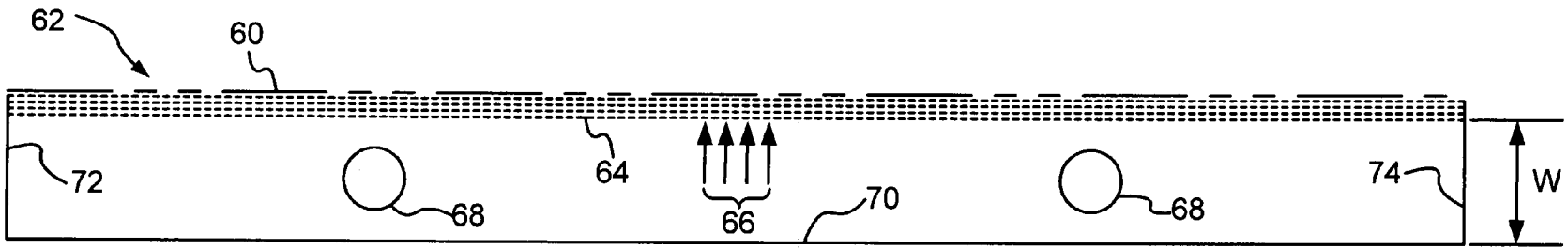
FIGURE 6

PERFORATED MULTI-LAYER OPTICAL FILM LUMINAIRE

TECHNICAL FIELD

This application pertains to transmissive light reflectors formed of highly reflective multi-layer optical film. Such reflectors can be used for luminance compensation in light boxes, to redirect light rays such that the rays are emitted with high luminance in a preferred direction. Such reflectors can also be used to produce high dynamic range static images having luminance values which vary as a selected function of position on the image.

BACKGROUND

Variable transmissivity light reflectors are well known prior art devices. Some light rays which are incident upon a variable transmissivity light reflector are partially transmitted through the reflector, some of the incident rays are reflected by the reflector and the remaining rays are absorbed by the reflector. The reflector's partially transmissive characteristic is not uniform, but varies as a function of the position at which the light rays are incident upon the reflector. In the simplest case, the reflector's transmissivity characteristic may be determined by just two values, one high and one low. For example, the high value may correspond to maximal transmission of incident light rays through the reflector (the "on" state) and the low value may correspond to minimal transmission of incident light rays through the reflector (the "off" state). The light emitting surface of a luminaire can be formed by providing a selected pattern of such on and off state reflector segments at predefined positions on the light emitting surface, with the pattern forming a simple image, such as letters for a sign. In more sophisticated cases the reflector's transmissivity characteristic may vary continuously as a function of position on the reflector, or may be a continuously varying half-tone pattern—in which case a grey scale photographic quality image can be produced on the luminaire's light emitting surface.

The two basic applications for such variable transmissivity light reflectors are luminance compensation, and production of high dynamic range static images. Luminance compensation generally involves redirection of light rays such that the rays are emitted in a preferred direction and with luminance values which vary as a selected function of position on a light emitting surface. For example, Whitehead U.S. Pat. No. 5,243,506 entitled "High Aspect Ratio Light Emitter Having High Uniformity and Directionality" employs luminance compensation to vary the degree of transmissivity of a light guide as a selected function of position to control the distribution of light emitted by the guide so as to achieve substantially uniform emission of light rays from the guide in a selected direction or within a selected angular range. Without such luminance compensation, the light guide would tend to emit light rays in a relatively nonuniform, nondirectional fashion, rendering the guide unsuitable for use in devices such as linear navigational beacons, which preferably emit maximum light intensity in a substantially horizontal direction; certain backlit liquid crystal displays, which preferably emit light only within a desired range of viewing angles; and certain vehicle signal lights, which preferably emit maximum light intensity only in desired directions.

To illustrate the luminance compensation problem, FIG. 1 depicts a typical prior art light box 10 of the type used in advertising signs. The interior of light box 10 contains and is illuminated by a plurality of fluorescent tubes 12, only two of which are shown. Light box 10's inside rearward surface 14 and inside side surfaces 16, 18 are coated or lined with a reflective material such as white paint or reflective film, it being understood that the best available prior art materials have intrinsic reflectance values of about 90%.

Light box 10's light emitting image display surface 20 has a variable transmissivity characteristic which varies as a function of position over light emitting surface 20. The particular variable transmissivity characteristic is selected to suit the image to be displayed on the outside of light emitting surface 20. That characteristic may be produced in a manner well known to persons skilled in the art, for example as explained in Whitehead U.S. Pat. Nos. 6,024,462 and 6,079,844 which are both titled "High Efficiency High Intensity Backlighting of Graphic Displays." For example, light emitting surface 20 may incorporate a perforated reflective material—it again being understood that the best available prior art materials have intrinsic reflectance values no greater than about 90%.

The width W of light box 10 (i.e. the displacement between rearward surface 14 and light emitting image display surface 20) must not be less than a predetermined minimum value—typically, the ratio of the width W of box 10 compared to the centre-to-centre spacing S between adjacent fluorescent tubes 12, where W/S is of order 1. Otherwise, an unacceptably large fraction of the light rays emitted by each fluorescent tube 12 will illuminate only a relatively small region 22 of light emitting surface 20 immediately adjacent the particular fluorescent tube. Due to the relatively low intrinsic reflectance value of the material incorporated in light emitting surface 20, an unacceptably large fraction of the light rays which illuminate regions 22 are absorbed by light emitting surface 20 and "lost." That is, such "lost" rays are neither transmitted through light emitting surface 20 to illuminate the displayed image, nor are they reflected by light emitting surface 20 back toward rearward surface 14 for further reflection and eventual transmission through some other region on light emitting surface 20.

Regions 22 typically overlap portions of the image to be displayed on light emitting surface 20. The variable transmissivity characteristic of light emitting surface 20 is accordingly selected to permit an appropriate fraction of light rays incident upon regions 22 to escape through light emitting surface 20 to illuminate the image. But the aforementioned loss of light rays due to absorption leaves insufficient light to be reflected for eventual transmission through some other region on light emitting surface 20. Such other regions are accordingly not illuminated to the same extent as regions 22. Consequently, observers perceive regions 22 as over-illuminated bright spots, which is undesirable. One prior art solution to this problem is to increase the width W of light box 10 to broaden regions 22 as shown in FIG. 2 and thereby reduce the perceptibility of bright spots on light emitting surface 20. However this unavoidably increases the size of light box 10, which is undesirable. Another prior art solution to the foregoing problem is to adjust the variable transmissivity characteristic of light emitting surface 20 to reduce the light transmission capability of light emitting surface 20 in each of regions 22, while making corresponding adjustments to the variable transmissivity characteristic of light emitting surface 20 outside regions 22. Such adjustment involves a cumbersome, time-consuming, iterative trial and error technique requiring a custom solution for every different light box (and for every different high dynamic range image). This application addresses the foregoing problem.

This application also discloses display of high dynamic range images. Dynamic range is the ratio of intensity of the highest and lowest luminance parts of a scene. For example, the image projected by a video projection system may have a maximum dynamic range of 300:1. This relatively low dynamic range is due to the relatively limited range of luminance values which can be reproduced by a typical video projection system. By contrast, the human visual system is capable of recognizing features in scenes which have very high dynamic ranges. For example, a person can look into the shadows of an unlit garage on a brightly sunlit day and see details of objects in the shadows, even though the luminance in adjacent sunlit areas may be tens of thousands of times greater than the luminance in the shadow parts of the scene.

There are many high dynamic range image situations which the human eye can perceive well, but which cannot be effectively displayed due to the dynamic range limitations of conventional image display systems. Examples include most situations where sources of light are in the field of view, such as sunset scenes, scenes containing highly reflective ("shiny") surfaces, or night scenes containing illuminated neon signs, lamps, etc. The ability to display a larger dynamic range of luminance values would facilitate production of more visually effective graphic images, such as scenes of the aforementioned type which contain sources of light. This would in turn have value both aesthetically and in more effective advertising. However, to display a realistic rendering of a scene of the foregoing type can require a display having a dynamic range in excess of 1000:1. In this specification, the term "high dynamic range" means dynamic ranges of 800:1 or more.

The foregoing examples of the related art and limitations related thereto are intended to be illustrative and not exclusive. Other limitations of the related art will become apparent to those of skill in the art upon a reading of the specification and a study of the drawings.

BRIEF DESCRIPTION OF DRAWINGS

Exemplary embodiments are illustrated in referenced figures of the drawings. It is intended that the embodiments and figures disclosed herein are to be considered illustrative rather than restrictive.

FIG. 5A graphically depicts a Monte Carlo ray tracing simulation of luminance distribution over the light emitting surface of a single light bulb prior art light box schematically depicted below the graph. FIG. 5B graphically depicts a Monte Carlo ray tracing simulation of luminance distribution over the light emitting surface of an improved single light bulb light box as schematically depicted below the graph. In both graphs luminance is plotted as a function of horizontal position on the surface of the light box.

FIG. 6 is a schematic top cross-sectional view (not to scale) of a light box in a high dynamic range image display context.

DESCRIPTION

Throughout the following description, specific details are set forth in order to provide a more thorough understanding of what is disclosed. However, what is disclosed may be practiced without these particulars. In other instances, well known elements have not been shown or described in detail to avoid unnecessarily obscuring the disclosure. Accordingly, the description and drawings are to be regarded in an illustrative, rather than a restrictive, sense.

Vikuti™ Enhanced Specular Reflector (ESR) multi-layer optical film (available from 3M Electronic Display Lighting, Optical Systems Division, St. Paul, Minn.) is preferably used as the reflector material in a variable transmissivity reflector. Such film has an intrinsic reflectance value of about 99%, meaning that about 99% of all light rays incident upon the film are reflected. Prior art variable transmissivity reflectors are typically formed using materials having intrinsic reflectance values no greater than about 90%. Although maximal benefit is attained by utilizing a multi-layer optical film having an intrinsic reflectance value of about 99% or greater, persons skilled in the art will understand that significant benefits can be attained by utilizing a multi-layer optical film having an intrinsic reflectance value of about 98% or greater, with lesser—albeit acceptable in some applications—benefits being attainable by utilizing a multi-layer optical film having an intrinsic reflectance value greater than about 95%.

Luminance Compensation

Figure 1:
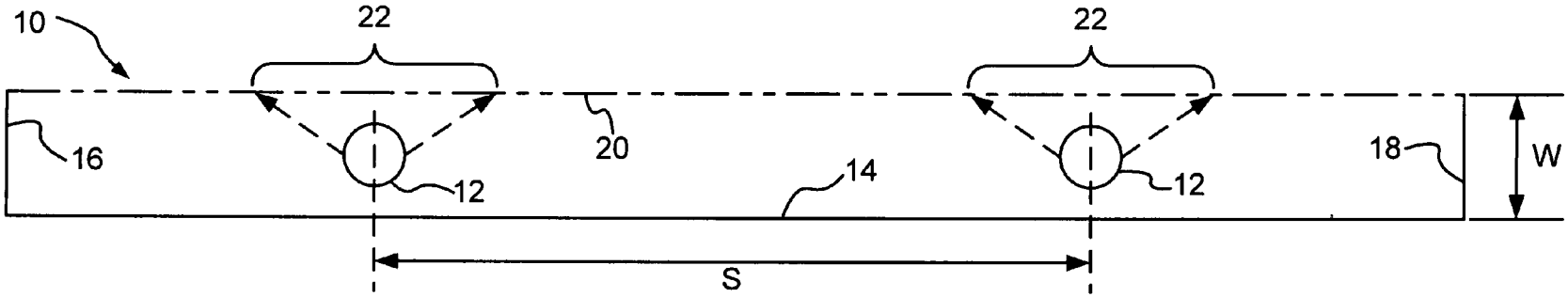
FIGURE 1 (PRIOR ART)
FIG. 1 is a schematic top cross-sectional view (not to scale) of a prior art light box.
Figure 2:
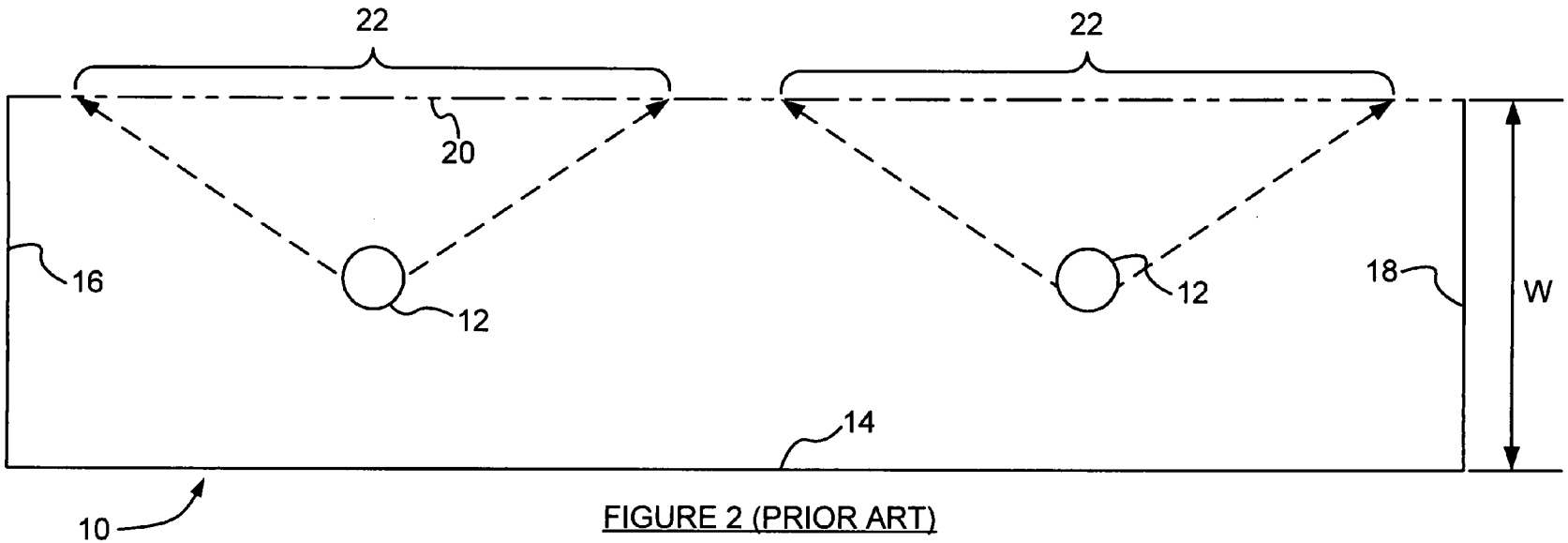
FIGURE 2 (PRIOR ART)
FIG. 2 shows (not to scale) the width of the FIG. 1 light box increased to reduce the perceptibility of undesirable bright spots.
Figure 3:
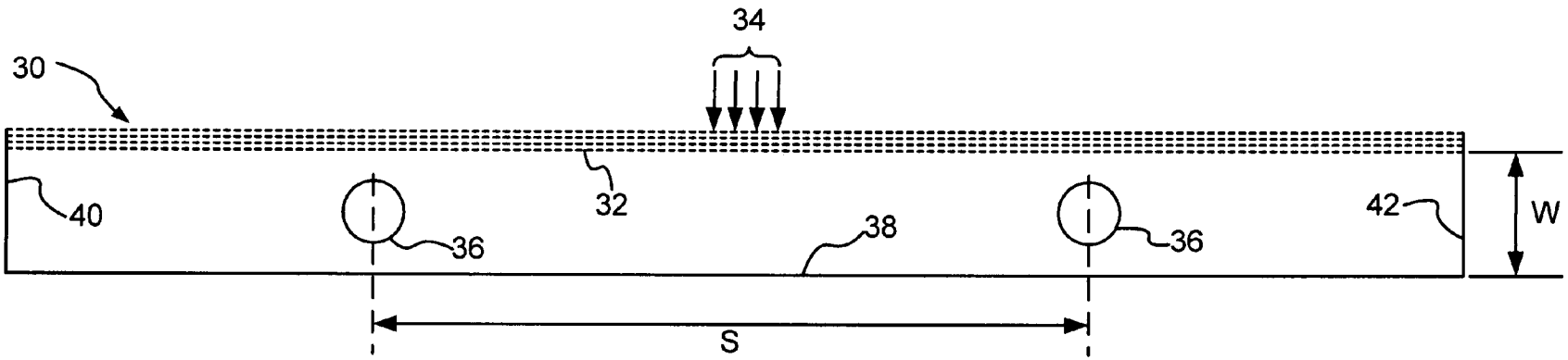
FIG. 3 is a schematic top cross-sectional view (not to scale) of a light box in a luminance compensation context.

One embodiment facilitates luminance compensation of light boxes like those depicted in FIGS. 1 and 2. FIG. 3 depicts such a light box 30 having a light emitting surface 32 having an intrinsic reflectance value greater than 95% and preferably about 99% or greater. This can for example be achieved by forming light emitting surface 32 of the Vikuti™ ESR multi-layer optical film mentioned above. A large plurality of perforations 34 are provided through light emitting surface 32, to give light emitting surface 32 a desired macroscopically non-varying extrinsic reflectance-reducing transmissivity characteristic as explained below. The size of and positional distribution of perforations 34 is greatly exaggerated in FIG. 1. In practice, each perforation 34 has a diameter of about 0.5 mm and the perforations are macroscopically positioned with uniform density per unit area on light emitting surface 32 to impart the desired macroscopically non-varying transmissivity characteristic to light emitting surface 32 in a manner well known to persons skilled in the art, as aforesaid.

The interior of light box 30 contains and is illuminated by a plurality of fluorescent tubes 36, only two of which are shown in FIG. 3. Light box 30's inside rearward surface 38 and inside side surfaces 40, 42 are formed of or lined with a material (e.g. the Vikuti™ ESR multi-layer optical film mentioned above) having an intrinsic reflectance value greater than 95% and preferably about 99% or greater. The width W of light box 30 can be less than would normally be tolerable. More particularly, the ratio W/S of the width W of light box 30 compared to the centre-to-centre spacing S between adjacent fluorescent tubes 36, can be of order 0.1—a 10-fold reduction in comparison to the FIG. 1 prior art structure.

Forming light emitting surface 32 of multi-layer optical film achieves more efficient utilization of light rays emitted by fluorescent tubes 36. Moreover, because multi-layer optical film can reflect light rays many times before the rays are absorbed and lost, light emitting surface 32 may have a non-varying transmissivity characteristic. That is, the transmissivity characteristic may simply be a macroscopically constant, low light transmission value at all points on the surface of light emitting surface 32, without causing an unacceptable loss in efficiency.

Figure 4:
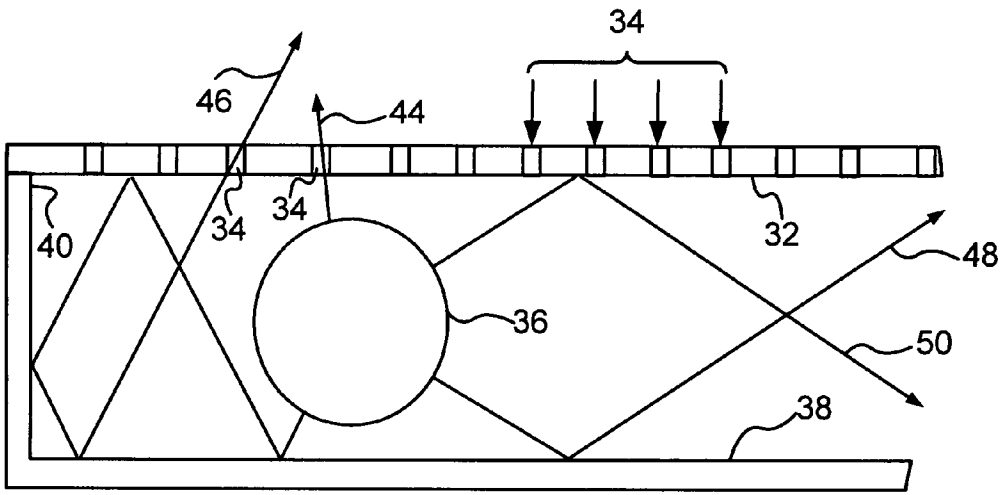
FIG. 4 depicts (not to scale) an enlarged fragmented portion of the FIG. 3 light box.

For example, if the size and positional distribution of perforations 34 are selected such that 10% of the light rays emitted by fluorescent tubes 36 are transmitted directly through perforations 34 without reflection (as in the case of ray 44 shown in FIG. 4), the high reflectance of light emitting surface 32 ensures that substantially all of the remaining 90% of light rays will eventually be transmitted through perforations 34 after an average of about 20 reflections per light ray (as schematically illustrated by rays 46, 48 and 50 shown in FIG. 4). Because that remaining 90% of light rays undergo many reflections before being transmitted through a randomly encountered one of perforations 34, the net effect is that the light rays are transmitted more uniformly through all points on the surface of light emitting surface 32 than would otherwise be the case.

Light box luminance compensation utilizing prior art reflective materials requires cumbersome, time-consuming, iterative trial and error techniques which must be customized for each light box in order to compensate for light absorption losses by imparting a variable transmissivity characteristic to the reflective material. The need for such compensation can be avoided—instead of utilizing a reflector with a variable transmissivity characteristic, one may employ a reflective material having a macroscopically non-varying extrinsic reflectance-reducing transmissivity characteristic as aforesaid. For example, a suitable reflector can be constructed by perforating multi-layer optical film to give the film a macroscopically constant, low light transmission value—a very significant advantage over the prior art.

FIGS. 5A and 5B respectively schematically depict Monte Carlo ray tracing simulations of a single light bulb thin prior art light box (FIG. 5A), and an improved light box (FIG. 5B). The relatively uniform luminance of the FIG. 5B embodiment is made apparent by the relatively flat plot of luminance values. The graphical portion of FIG. 5A depicts a slight dip in the luminance values directly above the fluorescent tube. This is due to the high reflectance of the multi-layer optical film. In most cases, especially at points on the light emitting surface which are close to the fluorescent tube, the luminance perceived by an observer is a composite of (1) luminance due to light rays which are transmitted directly from the fluorescent tube through perforations 34 without reflection; and (2) luminance due to reflection of the tube's image in the multi-layer optical film. However, if the light box is viewed from directly above, as illustrated in FIG. 5A, the luminance contribution of light rays due to reflection of the fluorescent tube's image is largely obscured by the tube itself. This results in the slight dip in luminance intensity shown in FIG. 5A.

It is not essential to perforate multi-layer optical film to permit light to escape through the film in order to achieve luminance compensation as described above. Other techniques can be used to allow light to controllably escape through the film. One approach is to optically couple a diffusive material to both sides of the multi-layer optical film to controllably enable some light to escape through film, as disclosed in Liu et al U.S. Pat. No. 6,208,466 issued 27 Mar. 2001. As one example, a half-tone or dot pattern of diffusive white ink can be printed on the film to control the amount of light transmitted through the film. Another approach is to "damage" the film in selected regions by disrupting the film's light reflecting capability and imparting a light transmissive capability to the film in such regions, e.g. by thermally degrading the film in such regions, or by using a laser beam to render the film substantially transparent in such regions, without perforating the film.

High Dynamic Range Image Display

A second embodiment facilitates production of high dynamic range static images. The second embodiment also utilizes multi-layer optical film having an intrinsic reflectance value greater than 95% (preferably about 99% or greater) and having a predefined variable transmissivity characteristic, corresponding to a predefined static image such as an advertisement which is to be displayed by mounting a transparent sheet 60 (FIG. 6) bearing the image on light box 62 and operating light box 62 to back light the image.

Light box 62 has a light emitting surface 64 having a first portion corresponding to a substantial area of light emitting surface 64, and a second portion corresponding to the remaining area of light emitting surface 64, excluding the first portion. Neither the first portion nor the second portion need be a contiguous segment of light emitting surface 64; each portion may be a plurality of non-contiguous segments of light emitting surface 64. The first portion of light emitting surface 64 is formed of multi-layer optical film having an intrinsic reflectance value greater than 95% and preferably about 99% or greater. The first portion of light emitting surface 64 also has a first extrinsic reflectance-reducing characteristic (e.g. perforations) giving the first portion a first light transmissivity characteristic of less than 5%, the first transmissivity characteristic being macroscopically invariant as a function of position over the first portion.

The second portion of light emitting surface 64 has a second extrinsic reflectance-reducing characteristic giving the second portion a second light transmissivity characteristic of greater than 25%. For example, a large plurality of perforations 66 can be provided through the second portion of light emitting surface 64, to give the second portion the desired second light transmissivity characteristic of greater than 25%. The size and positional distribution of perforations 66 is greatly exaggerated in FIG. 6. In practice, each perforation 66 may have a diameter of about 0.5 mm. However, the diameter of perforations 66 and their density per unit area on the second portion of light emitting, surface 64 can be selectably varied, in a manner well known to persons skilled in the art, to allow more or less light to escape through selected regions of the second portion of light emitting surface 64 so that brighter regions of image 60 will be illuminated more than darker regions of image 60, thus imparting the desired overall transmissivity characteristic to light emitting surface 64.

The interior of light box 62 contains and is illuminated by a plurality of fluorescent tubes 68, only two of which are shown in FIG. 6. That is, the inward side of light emitting surface 64 is backlit. Light box 62's inside rearward surface 70 and inside side surfaces 72, 74 are lined with multi-layer optical film having an intrinsic reflectance value greater than 95% and preferably about 99% or greater.

The variable transmissivity characteristic of light emitting surface 64 corresponds to sheet 60, which bears a static image. Sheet 60 extends substantially parallel to and in close proximity to the outward side of light emitting surface 64. The image consists of one or more normal luminance display regions and one or more high luminance display regions. Each normal luminance display region has the same size and shape as a corresponding segment of the first portion of light emitting surface 64. The normal luminance display regions have a third transmissivity characteristic which varies as a selected function of a desired normal luminance characteristic of the image. Each high luminance display region has the same size and shape as a corresponding segment of the second portion of light emitting surface 64. The high luminance display regions have a fourth transmissivity characteristic which varies as a selected function of a desired high luminance characteristic of the image. The third and fourth transmissivity characteristics of image-bearing sheet 60 are selected such that, in combination with the first and second transmissivity characteristics of light emitting surface 64, the resultant mathematical product of reflectances yields a net reflectance as a function of position corresponding to a selected high dynamic range image. Accordingly, the first, second, third and fourth light transmissivity characteristics together impart the desired high dynamic range to the image when the inward side of light emitting surface 64 is backlit.

Those portions of sheet 60 bearing high luminance display regions of the image (e.g. brighter parts of the image which are to be displayed at increased luminance) are more highly perforated than portions of sheet 60 bearing normal luminance display regions of the image which are to be displayed at reduced luminance (e.g. darker parts of the image). Alternatively, one may selectably remove those portions of the film which bear the high luminance display regions of the image in order to maximize the luminance of certain image highlights corresponding to those regions. The previously mentioned techniques can also be used to allow light to controllably escape through the film, without perforating the film. That is, one may optically couple a diffusive material to both sides of the multi-layer optical film to controllably enable some light to escape through film, as disclosed in Liu et al U.S. Pat. No. 6,208,466 issued 27 Mar. 2001; or, "damage" the film in selected regions by disrupting the film's light reflecting capability and imparting a light transmissive capability to the film in such regions.

The highly reflective multi-layer optical film "recycles" light rays which would otherwise be lost due to absorption by a prior art reflective material having a lower intrinsic reflectance value than the preferred multi-layer optical film. Specifically, the high reflectance of light emitting surface 64 ensures that most light rays emitted by fluorescent tubes 68 which are not transmitted through perforations 66 (or which do not escape through the film in accordance with some other technique) are reflected within light box 62 and eventually transmitted through perforations 66 after an average of about 20 reflections per light ray. This is especially advantageous in the display of high dynamic range images, since in most such images only a very small amount of the image is at full brightness. High light reflectance within light box 62 makes it possible to achieve much higher brightness illumination of the image (due to low loss multiple reflections of light rays) than would otherwise be the case.

In summary, high dynamic range images can be produced in either of two distinctly different ways. The first method uses a variably transmissive multi-layer optical film, in which regions corresponding to the bright regions of the image are more transmissive and regions corresponding to the dark regions of the image are less transmissive. The desired variable transmissivity characteristic can be achieved by either varying the size of the light transmissive perforations, or varying the size of the light transmissive pattern components (e.g. diffusive white ink dots), as long as the individual perforations or pattern components are invisible at reasonable viewing distances; and/or by varying the density of the light transmissive perforations or pattern components. When such a variably transmissive multi-layer optical film layer is combined with the image, the result is a high dynamic range image. The second method combines a uniformly transmissive multi-layer optical film with the image. To achieve high dynamic range, the film can be entirely removed in selected regions in order to maximize the luminance of image highlights corresponding to those regions.

The above-described luminance compensation technique can also be applied to the display of high dynamic range static images to reduce the width W of light box 62, making it possible for light box 62 to be thinner than would other wise be the case, improving the practicality of light box 62 in image display applications.

Variably transmissive multi-layer optical film suitable for use with either the luminance compensation or high dynamic range image display embodiments described above can be fabricated in various ways. As one example, the film itself can be modified to degrade its light reflecting capability and enhance its light transmitting capability. In principle this is easily done since it is difficult in practice to fabricate multi-layer optical film with suitably high reflectance. It is less challenging, in practice, to fabricate a film having a lower reflectance characteristic and a selected transmittance characteristic, although it can be difficult to achieve uniform transmittance as a function of wavelength, especially for all viewing angles. As another example, highly reflective multi-layer optical film can be perforated as aforesaid. In principle the perforations can be so small that they are imperceptible to an observer when the film is viewed from a reasonable distance (e.g. distances typical for observing signs) or viewed through a diffuser applied over the film or over the image. Spatial techniques can also be used to vary the film's light transmitting capability, e.g. by applying a positionally varying half tone pattern to the film, with the pattern varying in proportion to the desired level of light transmission at each position on the image. Another approach is to employ a film having a non-zero, but low light transmittance characteristic (say 5%), and perforate only those portions of the film corresponding to high brightness regions of the image. Automated cutting devices are readily available in the sign industry and are easily adapted to such perforation.

As will be apparent to those skilled in the art in the light of the foregoing disclosure, many alterations and modifications are possible without departing from the spirit or scope of this disclosure. Accordingly, the scope of the disclosure is to be construed in accordance with the substance defined by the following claims.

What is claimed is:

1. A high dynamic range image display light box, comprising:

(a) a light emitting surface having:

(i) an inward side and an outward side;

(ii) a first portion comprising:

(1) a substantial area of the light emitting surface;

(2) an intrinsic reflectance value greater than 95%;

(3) a first extrinsic reflectance-reducing characteristic giving the first portion a first light transmissivity characteristic of less than 5%, the first light transmissivity characteristic being macroscopically invariant as a function of position over the first portion;

(iii) a second portion comprising:

(1) the area of the light emitting surface excluding the first portion;

(2) a second extrinsic reflectance-reducing characteristic giving the second portion a second light transmissivity characteristic of greater than 25%;

(b) a sheet extending substantially parallel to and in close proximity to the outward side of the light emitting surface, the sheet bearing an image having:

(i) one or more normal luminance display regions, each normal luminance display region having:

(1) the same size and shape as a corresponding segment of the first portion of the light emitting surface;

(2) a third light transmissivity characteristic which varies as a selected function of a desired normal luminance characteristic of the image;

(ii) one or more high luminance display regions, each high luminance display region having:

(1) the same size and shape as a corresponding segment of the second portion of the light emitting surface;

(2) a fourth light transmissivity characteristic which varies as a selected function of a desired high luminance characteristic of the image; and (c) at least one diffuse light source on the inward side of the light emitting surface for emitting diffuse light onto the inward side of the light emitting surface;

wherein the third light transmissivity characteristic and the fourth light transmissivity characteristic are selected such that the first, second, third and fourth light transmissivity characteristics together impart a high dynamic range to the image when the inward side of the light emitting surface is backlit.

2. An image display light box as defined in claim 1, further comprising interior surfaces having an intrinsic reflectance value greater than 95%.

3. An image display light box as defined in claim 1, further comprising a light source and wherein the first extrinsic reflectance-reducing characteristic is provided by perforating the first portion of the light emitting surface to enable a preselected fraction of light rays emitted by the light source to be transmitted through the first portion of the light emitting surface without reflection.

4. An image display light box as defined in claim 1, further comprising a light source and wherein the first extrinsic reflectance-reducing characteristic is provided by removing one or more selected segments of the first portion of the light emitting surface to enable a preselected fraction of light rays emitted by the light source to be transmitted directly through the first portion of the light emitting surface without reflection.

5. An image display light box as defined in claim 1, further comprising a light source and wherein the first extrinsic reflectance-reducing characteristic is provided by disrupting the first portion of the light emitting surface to enable a preselected fraction of light rays emitted by the light source to be transmitted through the first portion of the light emitting surface without reflection.

6. An image display light box as defined in claim 1, wherein the light emitting surface has an intrinsic reflectance value of about 99% or greater.

7. An image display light box as defined in claim 2, wherein the light emitting surface has an intrinsic reflectance value of about 99% or greater.

8. An image display light box as defined in claim 3, wherein the light emitting surface has an intrinsic reflectance value of about 99% or greater.

9. An image display light box as defined in claim 4, wherein the light emitting surface has an intrinsic reflectance value of about 99% or greater.

10. An image display light box as defined in claim 5, wherein the light emitting surface has an intrinsic reflectance value of about 99% or greater.

11. An image display light box as defined in claim 6, wherein the light emitting surface further comprises multilayer optical film.

12. An image display light box as defined in claim 7, wherein the light emitting surface further comprises multilayer optical film.

13. An image display light box as defined in claim 8, wherein the light emitting surface further comprises multilayer optical film.

14. An image display light box as defined in claim 9, wherein the light emitting surface further comprises multilayer optical film.

15. An image display light box as defined in claim 10, wherein the light emitting surface further comprises multilayer optical film.

16. An image display light box as defined in claim 11, further comprising a light source and wherein a diffusive material is optically coupled to the second portion of the light emitting surface to enable a preselected fraction of light rays emitted by the light source to be transmitted through the second portion of the light emitting surface without reflection.

17. A high dynamic range image display method, comprising:

applying a static image to a sheet, the image having one or more normal luminance display regions and one or more high luminance display regions;

forming a light emitting surface of a material having an intrinsic reflectance value greater than 95%;

positioning an outward side of the light emitting surface substantially parallel to and in close proximity to the sheet;

dividing the light emitting surface into a first portion comprising a substantial area of the light emitting surface and a second portion comprising the area of the light emitting surface excluding the first portion;

subdividing the first portion of the light emitting surface to provide one light emitting surface first portion segment for each one of the normal luminance display regions, each light emitting surface first portion segment having the same size and shape as a corresponding one of the normal luminance display regions;

subdividing the second portion of the light emitting surface to provide one light emitting surface second portion segment for each one of the high luminance display regions, each light emitting surface second portion segment having the same size and shape as a corresponding one of the high luminance display regions;

altering a light transmissivity characteristic of the first portion of the light emitting surface to give the first portion a macroscopically positionally invariant first light transmissivity characteristic of less than 5%;

altering a light transmissivity characteristic of the second portion of the light emitting surface to give the second portion a second light transmissivity characteristic of greater than 25%;

altering a light transmissivity characteristic of the normal luminance display regions to give the normal luminance display regions a third light transmissivity characteristic which varies as a selected function of a desired normal luminance characteristic of the image;

altering a light transmissivity characteristic of the high luminance display regions to give the high luminance display regions a fourth light transmissivity characteristic which varies as a selected function of a desired high luminance characteristic of the image; and diffusely backlighting an inward side of the light emitting surface by emitting diffuse light onto the inward side of the light emitting surface;

wherein the third light transmissivity characteristic and the fourth light transmissivity characteristic are selected such that the first, second, third and fourth light transmissivity characteristics together impart a high dynamic range to the image when the inward side of the light emitting surface is backlit.

18. A high dynamic range image display method as defined in claim 17, wherein altering a light transmissivity characteristic of the first portion of the light emitting surface further comprises perforating the first portion of the light emitting surface.

19. A high dynamic range image display method as defined in claim 17, wherein altering a light transmissivity characteristic of the first portion of the light emitting surface further comprises removing one or more selected areas of the first portion of the light emitting surface.

20. A high dynamic range image display method as defined in claim 17, wherein altering a light transmissivity characteristic of the first portion of the light emitting surface further comprises disrupting the reflectance of the first portion of the light emitting surface.

21. A high dynamic range image display method as defined in claim 17, wherein the light emitting surface has an intrinsic reflectance value of about 99% or greater.

22. A high dynamic range image display method as defined in claim 18, wherein the light emitting surface has an intrinsic reflectance value of about 99% or greater.

23. A high dynamic range image display method as defined in claim 19, wherein the light emitting surface has an intrinsic reflectance value of about 99% or greater.

24. A high dynamic range image display method as defined in claim 20, wherein the light emitting surface has an intrinsic reflectance value of about 99% or greater.

25. A high dynamic range image display method as defined in claim 21, wherein the light emitting surface is formed of multi-layer optical film.

26. A high dynamic range image display method as defined in claim 22, wherein the light emitting surface is formed of multi-layer optical film.

27. A high dynamic range image display method as defined in claim 23, wherein the light emitting surface is formed of multi-layer optical film.

28. A high dynamic range image display method as defined in claim 24, wherein the light emitting surface is formed of multi-layer optical film.

29. A high dynamic range image display method as defined in claim 25, wherein altering a light transmissivity characteristic of the first portion segments further comprises optically coupling a diffusive material to the light emitting surface.

* * * * *